US012102121B2

(12) United States Patent
Abi Aoun et al.

(10) Patent No.: US 12,102,121 B2
(45) Date of Patent: Oct. 1, 2024

(54) AEROSOL GENERATION

(71) Applicant: NICOVENTURES TRADING LIMITED, London (GB)

(72) Inventors: Walid Abi Aoun, London (GB); Sally Bell, London (GB)

(73) Assignee: NICOVENTURES TRADING LIMITED, London (GB)

( * ) Notice: Subject to any disclaimer, the term of this patent is extended or adjusted under 35 U.S.C. 154(b) by 434 days.

(21) Appl. No.: 17/420,645

(22) PCT Filed: Dec. 20, 2019

(86) PCT No.: PCT/EP2019/086700
§ 371 (c)(1),
(2) Date: Jul. 2, 2021

(87) PCT Pub. No.: WO2020/141113
PCT Pub. Date: Jul. 9, 2020

(65) Prior Publication Data

US 2022/0071281 A1 Mar. 10, 2022

(30) Foreign Application Priority Data

Jan. 4, 2019 (GB) ..... 1900128

(51) Int. Cl.
*A24F 40/30* (2020.01)
*A24B 15/167* (2020.01)
*A24F 40/10* (2020.01)
*A24F 40/42* (2020.01)

(52) U.S. Cl.
CPC ..... *A24F 40/30* (2020.01); *A24B 15/167* (2016.11); *A24F 40/10* (2020.01); *A24F 40/42* (2020.01)

(58) Field of Classification Search
CPC ..... A24F 40/30; A24F 40/10; A24F 40/42; A24B 15/167
USPC ..... 131/329
See application file for complete search history.

(56) References Cited

U.S. PATENT DOCUMENTS 4,284,089 A 8/1981 Ray
4,846,199 A * 7/1989 Rose ..... A24F 40/485 131/273
4,848,374 A * 7/1989 Chard ..... A24F 42/10 131/194
4,907,606 A 3/1990 Lilja et al.
5,105,834 A 4/1992 Saintsing et al.
6,234,167 B1 * 5/2001 Cox ..... A24F 40/70 128/200.14
8,356,606 B2 1/2013 Sengupta et al.
2012/0006342 A1 1/2012 Rose et al.
2012/0312314 A1 12/2012 Plakidis et al.
2013/0160779 A1 6/2013 Chida et al.
2013/0160780 A1 6/2013 Matsumoto et al.
2014/0261488 A1 * 9/2014 Tucker ..... A24F 40/50 131/328
2014/0261491 A1 * 9/2014 Hawes ..... A61L 9/037 392/395
2014/0283855 A1 * 9/2014 Hawes ..... A24F 40/48 131/328
2015/0020822 A1 * 1/2015 Janardhan ..... A61M 15/06 131/328
2016/0021931 A1 * 1/2016 Hawes ..... F04B 19/006 392/394
2016/0205992 A1 7/2016 Bell et al.
2016/0235121 A1 * 8/2016 Rogan ..... H05B 1/0227
2017/0042245 A1 * 2/2017 Buchberger ..... A24F 40/50
2017/0172212 A1 * 6/2017 Phillips ..... H05B 1/0244
2017/0251727 A1 9/2017 Nielsen
2017/0319799 A1 11/2017 Yamada et al.
2017/0340018 A1 * 11/2017 Thorens ..... H05B 3/44
2017/0347706 A1 * 12/2017 Aoun ..... A24F 40/42
2018/0027882 A1 * 2/2018 Hepworth ..... A24F 40/42
2018/0035719 A1 * 2/2018 Turner ..... A24F 40/30
2018/0049477 A1 2/2018 Suzuki et al.
2018/0146711 A1 * 5/2018 Mazur ..... A61M 15/0028
(Continued)

FOREIGN PATENT DOCUMENTS

EP 2399637 A1 12/2011
EP 3251529 12/2017
KR 10-2015-0129683 A 11/2015
KR 20180111460 10/2018
WO 2007/054167 A1 5/2007
WO 2011/034723 A1 3/2011
WO 2014140320 A1 9/2014
(Continued)

OTHER PUBLICATIONS

International Search Report and Written Opinion for PCT/EP2019/086700 dated Apr. 17, 2020.
(Continued)

*Primary Examiner* — Gary F Paumen
(74) *Attorney, Agent, or Firm* — WOMBLE BOND DICKINSON (US) LLP

(57) ABSTRACT

A device for generating an inhalable medium, the device comprising: a container retaining a first volatilizable material; a heater for volatilising the first volatilizable material held in the container; a chamber containing aerosolizable material comprising nicotine; a reservoir containing a basic solution; and an outlet; the arrangement being such that in use, the basic solution is released from the reservoir and enters the chamber containing the aerosolizable material, and the first volatilizable material is volatilized by the heater to form a vapor and/or an aerosol, which passes through the chamber containing aerosolizable material and entrains one or more constituents of the aerosolizable material, thereby forming an inhalable medium which passes through the outlet.

20 Claims, No Drawings

(56) References Cited

U.S. PATENT DOCUMENTS

| | | | | |
|---|---|---|---|---|
| 2018/0279666 | A1 | 10/2018 | Aoun et al. | |
| 2018/0279667 | A1 | 10/2018 | McAdam et al. | |
| 2018/0279678 | A1* | 10/2018 | Hepworth | A24F 40/42 |
| 2018/0343920 | A1* | 12/2018 | Sutton | A24D 1/20 |

FOREIGN PATENT DOCUMENTS

| | | | |
|---|---|---|---|
| WO | 2016/050244 | A1 | 4/2016 |
| WO | 2016/079729 | A1 | 5/2016 |
| WO | 2018/033649 | A1 | 2/2018 |

OTHER PUBLICATIONS

Nicoventures Trading Limited; CA Office Action dated Sep. 29, 2022 from related CA Application No. 3,124,606; 5 pages.

Nicoventures Trading Limited; KR Office Action dated Apr. 13, 2023 from related KR Application No. 10-2021-7024437; 6 pages.

* cited by examiner

AEROSOL GENERATION

The present application is a National Phase entry of PCT Application No. PCT/EP2019/086700, filed Dec. 20, 2019 which claims priority from GB Patent Application No. 1900128.8 filed Jan. 4, 2019, each of which is hereby fully incorporated herein by reference.

TECHNICAL FIELD

The present invention relates, without limitation, to a device for generating an inhalable medium, a cartridge for use in a device for generating an inhalable medium, and a kit.

BACKGROUND

Smoking articles such as cigarettes, cigars and the like burn tobacco during use to create tobacco smoke. Alternatives to these types of articles, release compounds without burning to form an inhalable medium.

Examples of such products are heating devices include e-cigarette/heat-not-burn hybrid devices, also known as electronic tobacco hybrid devices. These hybrid devices contain a vapor or aerosol precursor (such as a liquid or gel) which is vaporized by heating to produce an inhalable vapor or aerosol. The vapor precursor may contain flavorings and/or aerosol-generating substances, such as glycerol and in some instances, nicotine. The vapor or aerosol passes through a substrate material in the device and entrains one or more constituents of that substrate material to produce the inhaled medium. The substrate material may be, for example, tobacco, other non-tobacco products or a combination, such as a blended mix, which may or may not contain nicotine. An example of an electronic tobacco hybrid device is disclosed in WO2016/135331.

SUMMARY

In some embodiments described herein, the disclosure provides a device for generating an inhalable medium, the device comprising:

a container retaining a first volatilizable material;

a heater for volatilizing the first volatilizable material held in the container;

a chamber containing aerosolizable material comprising nicotine;

a reservoir containing a basic solution; and an outlet;

the arrangement being such that in use, the basic solution is released from the reservoir and enters the chamber containing the aerosolizable material, and the first volatilizable material is volatilized by the heater to form a vapor and/or an aerosol, which passes through the chamber containing aerosolizable material and entrains one or more constituents of the aerosolizable material, thereby forming an inhalable medium which passes through the outlet.

The device described herein may be referred to as an electronic tobacco hybrid device.

In some embodiments described herein, the disclosure provides a cartridge for use in a device for generating an inhalable medium, the cartridge comprising (i) a first volatilizable material in a container, (ii) an aerosolizable material comprising nicotine in a chamber, and (iii) a basic solution contained in a reservoir, the cartridge being configured such that in use, the basic solution is released from the reservoir and enters the chamber containing the aerosolizable material, and a vapor and/or an aerosol generated from the first volatilizable material passes through the chamber containing an aerosolizable material and entrains one or more constituents of the aerosolizable material.

Suitably, the cartridge may be adapted for use in the device for generating an inhalable medium described herein.

In some embodiments described herein, the disclosure provides kit comprising;

(i) a first pod containing a first volatilizable material; and (ii) a second pod having (a) a chamber containing an aerosolizable material comprising nicotine, and (b) a reservoir containing a basic solution;

wherein the first and second pods are configured for use in a device such that in use, the basic solution is released from the reservoir and enters the chamber containing the aerosolizable material, and a vapor and/or an aerosol generated from the first volatilizable material passes through the aerosolizable material and entrains one or more constituents of the aerosolizable material.

Further features and advantages of the disclosure will become apparent from the following description of preferred embodiments of the disclosure, given by way of example only.

DETAILED DESCRIPTION

Tobacco can be treated with base and water in order to ease liberation of nicotine from the tobacco. Nicotine is liberated from nicotine salts in tobacco by reaction with the base. Nicotine is then volatilized at a lower temperature in use.

The inventors have determined that if base-treated tobacco is used in known electronic tobacco hybrid devices, nicotine delivery per puff significantly drops during use. The reaction between base and nicotine occurs quickly; the pH-treated nicotine is then is liberated quickly and delivery during consumption may reduce from puff to puff. The inventors have also observed that nicotine from base-pH-treated tobacco may be lost from the device prior to use due to its high volatility.

The present disclosure provides improved consistency of nicotine delivery per puff through delaying pH-treatment of the tobacco. The disclosure provides a basic solution in a reservoir, wherein the basic solution is introduced into the chamber containing the nicotine-containing material in use. The basic solution may, in some cases, be introduced into the chamber containing the nicotine-containing material at the beginning of the consumption period (i.e. before the first puff); this prevents losses of pH-treated nicotine prior to use. In some other cases, the basic solution may be introduced into the chamber containing the nicotine-containing material during the consumption period (i.e. during puffing); this prevents losses of pH-treated nicotine prior to use, and the rate of introduction can be limited to control the rate of pH treatment of the material and therefore control the rate of nicotine liberation by the pH treatment, providing more sustained nicotine delivery to the user.

Moreover, high-pH treatment of tobacco (which is an aerosolizable material comprising nicotine) results in the liberation of ammonia. Control of the rate of basic pH treatment controls the rate of release of ammonia, and this can improve the organoleptic properties of the tobacco (since the smell of ammonia is less strong).

In some cases, the disclosure provides a device for generating an inhalable medium, the device comprising:

a container retaining a first volatilizable material;

a heater for volatilizing the first volatilizable material held in the container;

a chamber containing aerosolizable material comprising nicotine;

a reservoir containing a basic solution; and an outlet;

the arrangement being such that in use, the basic solution is released from the reservoir and enters the chamber containing the aerosolizable material, and the first volatilizable material is volatilized by the heater to form a vapor and/or an aerosol, which passes through the chamber containing aerosolizable material and entrains one or more constituents of the aerosolizable material, thereby forming an inhalable medium which passes through the outlet.

The device described herein may be referred to as an electronic tobacco hybrid device. The vapor and/or aerosol typically entrains organic and other compounds or constituents from the aerosolizable material that have organoleptic properties, thus imparting flavor to the aerosol or vapor as it passes to the outlet.

In some cases, the aerosolizable material comprising nicotine may be porous, such that an aerosol or vapor can pass through the material. Thus, components of the aerosolizable material are efficiently entrained in the aerosol/vapor as it passes through the material.

The aerosolizable material comprising nicotine may typically be a solid material. In some cases, it may comprise a tobacco material, which may also be referred to as a tobacco composition. Discussion herein specifically relating to the pH-treatment of a tobacco material is explicitly disclosed in combination with any aerosolizable material comprising nicotine, to the extent that they are compatible.

As used herein, the term "tobacco material" refers to any material comprising tobacco or derivatives therefore. The term "tobacco material" may include one or more of tobacco, tobacco derivatives, expanded tobacco, reconstituted tobacco or tobacco substitutes. The tobacco material may comprise one or more of ground tobacco, tobacco fiber, cut tobacco, extruded tobacco, tobacco stem, reconstituted tobacco, agglomerated tobacco, spheronised tobacco and/or tobacco extract.

The tobacco used to produce tobacco material may be any suitable tobacco, such as single grades or blends, cut rag or whole leaf, including Virginia and/or Burley and/or Oriental. It may also be tobacco particle 'fines' or dust, expanded tobacco, stems, expanded stems, and other processed stem materials, such as cut rolled stems. The tobacco material may be a ground tobacco or a reconstituted tobacco material. The reconstituted tobacco material may comprise tobacco fibers, and may be formed by casting, a Fourdrinier-based paper making-type approach with back addition of tobacco extract, or by extrusion.

The aerosolizable material comprising nicotine may additionally comprise flavorings and/or aerosol generating agents.

The aerosolizable material comprising nicotine may additionally comprise one or more casings, such as invert sugar, molasses, cane sugar, honey, cocoa, liquorice, polyols such as glycerol and propylene glycol and acids such as malic acid.

The aerosolizable material may additionally comprise one or more binders, such as alginates, celluloses or modified celluloses, starches or modified starches, or natural gums. In some embodiments, the aerosolizable material comprises an alginate such as sodium alginate, calcium alginate, potassium alginate or ammonium alginate.

The aerosolizable material may additionally comprise one or more fillers. Suitably, the filler may comprise an inorganic material such as calcium carbonate, perlite, vermiculite, diatomaceous earth, colloidal silica, magnesium oxide, magnesium sulphate and magnesium carbonate. In some cases, the filler comprises chalk. Suitably, the filler may comprise an organic material such as wood pulp, cellulose and cellulose derivatives.

Suitably, the aerosolizable material comprising nicotine (prior to use) may have a pH of less than about 7, as measured according to the CORESTA protocol for measuring the pH of tobacco.

The device comprises a container which retains a first volatilizable material which can be volatilized in use to form a vapor and/or an aerosol. The first volatilizable material may alternatively be referred to as a vapor/aerosol precursor. The first volatilizable material may, in some cases, comprise a gel or liquid. Suitably, the first volatilizable material comprises, substantially consists of or consists of a liquid. Suitable liquids include components conventionally used in e-cigarette liquids.

The first volatilizable material may comprise aerosol-generating agents, such as propylene glycol and/or glycerol. Additionally, it may in some cases comprise flavorings. The material is typically volatilized at around 100-300° C., suitably at around 150-250° C.

In some cases, the first volatilizable material does not contain nicotine.

The basic solution may, in some cases, comprise an aqueous solution of sodium hydroxide, potassium hydroxide, calcium hydroxide, sodium hydrogen carbonate, potassium hydrogen carbonate, calcium hydrogen carbonate, sodium carbonate, potassium carbonate, calcium carbonate or mixtures thereof, or other GRAS water-soluble bases.

The pH-treatment of the aerosolizable material comprising nicotine may raise the pH of that material to more than about 7 (as measured according to the CORESTA protocol for measuring the pH of tobacco). Suitably, the pH of the treated material may be less than about 11. Suitably, the pH may be between about 8 and 9.

The basic solution is retained in a reservoir. The reservoir is, in some cases, is located outside of the chamber containing the aerosolizable material and outside of the container retaining a first volatilizable material.

In some cases, the basic solution is retained in the reservoir prior to use by a barrier material which is ruptured in use to release the basic solution. The barrier material may be ruptured by any suitable mechanism. For example, the barrier material may be pierced by a piercing member. The user may actuate the piercing member, or it may be that insertion of the reservoir into the device causes the piercing member to rupture the barrier. In other cases, the barrier material may be one that melts, decomposes, reacts, degrades, swells, dissolves or deforms to release the base at a temperature above room temperature but at or below the temperature reached during use. For instance, the barrier material may be selected from a polysaccharide or cellulosic barrier material, a gelatin, a gum, a gel, a wax or a mixture thereof. In some cases, the encapsulating material is selected from one or more of alginates, dextran, maltodextrin, cyclodextrin, pectin, methyl cellulose, ethyl cellulose, hydroxyethyl cellulose, hydroxypropyl cellulose, carboxymethyl cellulose, cellulose ethers, gum Arabic, gum ghatti, gum tragacanth, Karaya, locust bean, acacia gum, guar, quince seed, xanthan gums, agar gel, agarose gel, carrageenans, furoidan, furcellaran and carnauba wax.

In some cases, the basic solution may be pumped from the reservoir into the chamber in use. In some cases, the pump may be actuated by the user. The pump may, in some cases, be mechanically operated and responsive to an input of the user. The pump may, in some cases, be electrically operated and responsive to the device control circuitry. Such an electrically operated pump may be responsive to a user input (e.g. pressing a button or the like) or may be puff actuated (i.e. responsive to a puff sensor). In some other cases, the pump may be a passive (e.g. a turbine or form of diaphragm) and may be configured to pump the basic solution in response to a pressure differential caused by a user puff In some cases, the basic solution may be transferred to the aerosolizable material prior to the first puff; this prevents losses of pH-treated nicotine prior to use. In some other cases, the basic solution may be introduced into the chamber containing the nicotine-containing material during the consumption period (i.e. during puffing); this prevents losses of pH-treated nicotine prior to use. Moreover, staggered release (e.g. to coincide with each puff) of the basic solution means that the rate of pH treatment of the material is controlled and therefore control the rate of nicotine liberation by the pH treatment, providing more sustained nicotine delivery to the user.

In some cases, the device heats the aerosolizable material comprising nicotine in use, encouraging release of material components into the inhaled medium. In some cases, one heater may heat both the first volatilizable material and the aerosolizable material comprising nicotine. In some cases, a second heater may be provided which heats the aerosolizable material comprising nicotine. In some cases, the device does not heat the aerosolizable material comprising nicotine, relying on heat carried by the vapor/aerosol to warm the aerosolizable material (thereby volatilizing components of the aerosolizable material which are then entrained in the vapor/aerosol flow).

In an embodiment, the device comprises a cooler or cooling zone downstream of the heater and upstream of the chamber containing aerosolizable material comprising nicotine, the cooler or cooling zone being arranged to cool vaporized material to form an aerosol of liquid droplets which in use passes through the aerosolizable material in the chamber. The cooler may be arranged in effect to act as a heat exchanger, allowing for recovery of heat from the vapor. The recovered heat can be used for example to pre-heat the aerosolizable material and/or to assist in heating the first volatilizable material.

In an embodiment, the device is battery-operated. The battery may be a rechargeable battery or a disposable battery.

In an embodiment, the or each heater is an electrically resistive heater, such as a nichrome resistive heater, a ceramic heater etc. The heater may be for example a wire, which may for example be in the form of a coil, a plate (which may be a multi-layer plate of two or more different materials, one or more of which may be electrically conductive and one or more of which may be electrically non-conductive), a mesh (which may be woven or non-woven for example, and which again may be similarly multi-layer), a film heater, etc. Other heating arrangements may be used, including non-electrical heating arrangements. In some cases, the heater may comprise an inductive heater.

In an embodiment, the container holding the first volatilizable material is removable. The container may be in the form of a pot or the like (which in some embodiments may be annular for example), and/or an absorbent wadding or the like. The container may in effect be a disposable item which is replaced as a whole after use. As an alternative, the arrangement may be such that the user removes the container from the device, replaces used volatilizable material or tops up the material in the container, and then places the container back in the device.

In some cases, the container may be non-removable from the device. In such an embodiment, the user may just replace used material or top up material in the container after use as necessary.

In some cases, the container and the chamber are an integral unit. In some cases, the integral unit is a cartridge that can be removed from the device.

In some cases, the chamber is removable from the device. The chamber may be, for example, in the form of a cartridge or the like which contains the aerosolizable material comprising nicotine before use. The whole chamber containing the aerosolizable material comprising nicotine may in effect be a disposable item which is replaced as a whole after use. As an alternative, the arrangement may be such that the user removes the chamber from the device, replaces used material in the chamber, and then places the chamber back in the device.

In some cases, the reservoir containing the basic solution is removable from the device. It may in effect be a disposable item which is replaced as a whole after use. As an alternative, the arrangement may be such that the user removes the reservoir from the device, tops up the basic solution, and then places the reservoir back in the device. In some other cases, the reservoir may be non-removable from the device. In such cases, the user may just top up the solution in the reservoir after use as necessary.

In some cases, the reservoir and container are an integral unit. In some cases, the reservoir and the chamber are an integral unit. In some cases, the reservoir, container and chamber are an integral unit, which may be a cartridge that can be removed from the device.

In some embodiments described herein, the disclosure provides a cartridge for use in a device for generating an inhalable medium, the cartridge comprising (i) a first volatilizable material in a container, (ii) an aerosolizable material comprising nicotine in a chamber, and (iii) a basic solution contained in a reservoir, the cartridge being configured such that in use, the basic solution is released from the reservoir and enters the chamber containing the aerosolizable material, and a vapor and/or an aerosol generated from the first volatilizable material passes through the chamber containing an aerosolizable material and entrains one or more constituents of the aerosolizable material. Suitably, the cartridge may be adapted for use in the device for generating an inhalable medium described herein.

To the extent that they are compatible, features described in relation to the device are explicitly disclosed in combination with the cartridge and vice versa. Specifically, features of the aerosolizable material comprising nicotine or volatilizable material described herein are explicitly disclosed in combination with the device and cartridge embodiments of the disclosure.

As used herein, "aerosol generating agent" refers to a compound or mixture that promotes the generation of an aerosol. An aerosol generating agent may promote the generation of an aerosol by promoting an initial vaporization and/or the condensation of a gas to an inhalable solid and/or liquid aerosol.

In general, any suitable aerosol generating agent or agents may be included in the aerosol generating material of the disclosure. Suitable aerosol generating agents include, but are not limited to: a polyol such as sorbitol, glycerol, and glycols like propylene glycol or triethylene glycol; a non-polyol such as monohydric alcohols, high boiling point hydrocarbons, acids such as lactic acid, glycerol derivatives, esters such as diacetin, triacetin, triethylene glycol diacetate, triethyl citrate or myristates including ethyl myristate and isopropyl myristate and aliphatic carboxylic acid esters such as methyl stearate, dimethyl dodecanedioate and dimethyl tetradecanedioate.

As used herein, the terms "flavor" and "flavoring" refer to materials which, where local regulations permit, may be used to create a desired taste or aroma in a product for adult consumers. They may include extracts (e.g., liquorice, hydrangea, Japanese white bark magnolia leaf, chamomile, fenugreek, clove, menthol, Japanese mint, aniseed, cinnamon, herb, wintergreen, cherry, berry, peach, apple, Drambuie, bourbon, scotch, whiskey, spearmint, peppermint, lavender, cardamom, celery, cascarilla, nutmeg, sandalwood, bergamot, geranium, honey essence, rose oil, vanilla, lemon oil, orange oil, cassia, caraway, cognac, jasmine, ylang-ylang, sage, fennel, piment, ginger, anise, coriander, coffee, or a mint oil from any species of the genus Mentha), flavor enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, oil, liquid, or powder.

For the avoidance of doubt, where in this specification the term "comprises" is used in defining the invention or features of the invention, embodiments are also disclosed in which the invention or feature can be defined using the terms "consists essentially of" or "consists of" in place of "comprises".

The above embodiments are to be understood as illustrative examples of the invention. Further embodiments of the invention are envisaged. It is to be understood that any feature described in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the invention, which is defined in the accompanying claims.

The various embodiments described herein are presented only to assist in understanding and teaching the claimed features. These embodiments are provided as a representative sample of embodiments only, and are not exhaustive and/or exclusive. It is to be understood that advantages, embodiments, examples, functions, features, structures, and/or other aspects described herein are not to be considered limitations on the scope of the invention as defined by the claims or limitations on equivalents to the claims, and that other embodiments may be utilized and modifications may be made without departing from the scope of the claimed invention. Various embodiments of the invention may suitably comprise, consist of, or consist essentially of, appropriate combinations of the disclosed elements, components, features, parts, steps, means, etc., other than those specifically described herein. In addition, this disclosure may include other inventions not presently claimed, but which may be claimed in future.

The invention claimed is:

1. A device for generating an inhalable medium, the device comprising:

a container retaining a first volatilizable material;

a heater for volatilizing the first volatilizable material held in the container;

a chamber containing aerosolizable material comprising nicotine;

a reservoir containing a basic solution; and an outlet;

the arrangement being such that in use, the basic solution is released from the reservoir and enters the chamber containing the aerosolizable material, and the first volatilizable material is volatilized by the heater to form a vapor and/or an aerosol, which passes through the chamber containing aerosolizable material and entrains one or more constituents of the aerosolizable material, thereby forming an inhalable medium which passes through the outlet.

2. A device according to claim 1, wherein the first volatilizable material comprises a liquid or gel.

3. A device according to claim 1, wherein the basic solution comprises an aqueous solution of sodium hydroxide, potassium hydroxide, calcium hydroxide, sodium hydrogen carbonate, potassium hydrogen carbonate, calcium hydrogen carbonate, sodium carbonate, potassium carbonate, calcium carbonate or mixtures thereof, or other soluble bases.

4. A device according to claim 1, wherein the basic solution is retained in the reservoir prior to use by a barrier material which is ruptured in use to release the basis solution.

5. A device according to claim 1, wherein the basic solution is pumped from the reservoir into the chamber in use.

6. A device according to claim 5, wherein the pump is puff-actuated.

7. A device according to claim 1, wherein the first volatilizable material does not contain nicotine.

8. A device according to claim 2, wherein the basic solution comprises an aqueous solution of sodium hydroxide, potassium hydroxide, calcium hydroxide, sodium hydrogen carbonate, potassium hydrogen carbonate, calcium hydrogen carbonate, sodium carbonate, potassium carbonate, calcium carbonate or mixtures thereof, or other soluble bases.

9. A cartridge for use in a device for generating an inhalable medium, the cartridge comprising (i) a first volatilizable material in a container, (ii) an aerosolizable material comprising nicotine in a chamber, and (iii) a basic solution contained in a reservoir, the cartridge being configured such that in use, the basis solution is released from the reservoir and enters the chamber containing the aerosolizable material, and a vapor and/or an aerosol generated from the first volatilizable material passes through the chamber containing the aerosolizable material and entrains one or more constituents of the aerosolizable material.

10. A cartridge according to claim 9, wherein the first volatilizable material comprises a liquid or gel.

11. A cartridge according to claim 9, wherein the basic solution comprises an aqueous solution of sodium hydroxide, potassium hydroxide, calcium hydroxide, sodium hydrogen carbonate, potassium hydrogen carbonate, calcium hydrogen carbonate, sodium carbonate, potassium carbonate, calcium carbonate or mixtures thereof, or other soluble bases.

12. A cartridge according to claim 9, wherein the basic solution is retained in the reservoir prior to use by a barrier material which is ruptured in use to release the basic solution.

13. A cartridge according to claim 9, wherein the basic solution is pumped from the reservoir into the chamber in use.

14. A cartridge according to claim 9, wherein the first volatilizable material does not contain nicotine.

15. A cartridge according to claim 10, wherein the basic solution comprises an aqueous solution of sodium hydroxide, potassium hydroxide, calcium hydroxide, sodium hydrogen carbonate, potassium hydrogen carbonate, calcium hydrogen carbonate, sodium carbonate, potassium carbonate, calcium carbonate or mixtures thereof, or other soluble bases.

16. A kit comprising;

(i) a first pod containing a first volatilizable material; and (ii) a second pod having (a) a chamber containing an aerosolizable material comprising nicotine, and (b) a reservoir containing a basic solution;

wherein the first and second pods are configured for use in a device such that in use, the basic solution is released from the reservoir and enters the chamber containing the aerosolisable material, and a vapor and/or an aerosol generated from the first volatilizable material passes through the aerosolizable material and entrains one or more constituents of the aerosolizable material.

17. A kit according to claim 16, wherein the first volatilizable material is a liquid or gel.

18. A kit according to claim 16, further comprising a device for use in generating an inhalable medium, wherein the device comprises a heater.

19. A kit according to claim 18, wherein the heater in the device is configured to volatilize the first volatilizable material in use.

20. A kit according to claim 16, wherein the basic solution comprises an aqueous solution of sodium hydroxide, potassium hydroxide, calcium hydroxide, sodium hydrogen carbonate, potassium hydrogen carbonate, calcium hydrogen carbonate, sodium carbonate, potassium carbonate, calcium carbonate or mixtures thereof, or other soluble bases.

* * * * *